United States Patent [19]

Berg et al.

[11] Patent Number: 4,613,174

[45] Date of Patent: Sep. 23, 1986

[54] REVERSIBLE LATCHING HINGE

[75] Inventors: Robin L. Berg, Hudson, Wis.; Douglas Morrissette, Plymouth; Walter Ecker, North St. Paul, both of Minn.

[73] Assignee: Syntechnics, Inc., Tenn.

[21] Appl. No.: 673,341

[22] Filed: Dec. 24, 1984

[51] Int. Cl.[4] ..... E05C 3/14; B61D 39/00

[52] U.S. Cl. ..... 292/136; 16/231; 105/377

[58] Field of Search ..... 105/272, 276, 281, 377; 414/359, 360; 292/130, 136; 16/231, 232; 220/315, 324

[56] References Cited

U.S. PATENT DOCUMENTS

| | | | |
|---|---|---|---|
| Re. 29,816 | 10/1978 | Winsor et al. | 105/377 |
| 1,828,797 | 10/1931 | Becker | 16/231 |
| 2,201,370 | 5/1940 | Julien | 16/231 |
| 2,817,870 | 12/1957 | Howell | 16/231 |
| 3,461,818 | 8/1969 | Sanders et al. | 105/377 |
| 3,493,131 | 2/1970 | Allen | 105/377 |
| 3,583,334 | 6/1971 | Schuller | 105/377 |
| 3,583,335 | 6/1971 | Schilf | 105/377 |
| 3,685,093 | 8/1972 | Sanders et al. | 16/231 |

FOREIGN PATENT DOCUMENTS

| | | | |
|---|---|---|---|
| 1289602 | 9/1972 | United Kingdom | 16/231 |

*Primary Examiner*—Robert B. Reeves
*Assistant Examiner*—Dennis C. Rodgers
*Attorney, Agent, or Firm*—Oblon, Fisher, Spivak, McClelland & Maier

[57] ABSTRACT

A reversible latching hinge for the roof of a container such as a railway car which is adapted to be inverted to a discharging position. The latching hinge allows the roof to pivot away automatically from the opening of the container during inversion. The reversible latching hinge is designed so as to minimize or eliminate undesirable impact loading that may arise from lateral displacement of the roof during inversion. The construction includes flanges extending laterally outward from the roof and terminating in ears which extend toward latch bars mounted to the container. Contact between the ears and the latch bars forms a pivot point for the roof. The construction also includes freely pivoting hooks which, on the upper side of the roof engage the latch bars to prevent the roof from falling off of the container. The hooks on the lower side disengage from the latch bars by gravity to permit the roof to swing outwardly during inversion.

2 Claims, 6 Drawing Figures

REVERSIBLE LATCHING HINGE

BACKGROUND OF THE INVENTION

1. Field of the Invention

The reversible latching hinge of the present invention is for use in open-topped containers, such as railway cars or the like, which are intended to be inverted for dumping their contents. The present invention is both a hinge and a latch for a roof of such a container, and allows the roof to swing away automatically from the opening side of the container when the container is inverted.

2. Description of the Prior Art

It is known to invert containers such as railway cars about a longitudinal axis in order to dump the contents of the container. It also is known that such containers may have roofs hinged and latched at the upper sidewalls of the container such that, when the container is pivoted about its longitudinal axis is either a clockwise or counterclockwise direction for dumping the contents, the uppermost latch may form a hinge for swinging motion of the roof, while the lowermost latch may automatically disengage to permit the roof to swing away from the opening. Such containers are disclosed in U.S. Pat. No. 3,461,818 of Sanders et al, U.S. Pat. No. 3,493,131 of Allen, U.S. Pat. No. 3,583,334 of Schuller and U.S. Pat. No. 3,583,335 of Schilf et al. In each of the above references, the latching hinge that interconnects the roof and the container is designed such that the roof is displaced laterally with respect to the container during inversion of the container. In each case, the lateral displacement is necessary for the functioning of the latching hinge.

It also is known in such apparatus that the roof may be moved when the container is upright to allow for the container to be filled by gravity. In such cases, either the roof is lifted about one side such that it pivots about the other side, or is lifted by both sides and removed entirely from the container. See the references to Shilf et al and Allen.

SUMMARY OF THE INVENTION

The reversible latching hinge of the present invention avoids lateral displacement of a roof of a container during inversion of the container while still allowing for the roof to pivot away from the opening of the container about the upper edge of the roof. Avoiding such lateral displacement of the roof provides the distinct advantage of minimizing or eliminating impact loading on the roof, container and latching hinge that occurs at the end of the lateral displacement in the cited references. Eliminating or minimizing the impact loading greatly increases the useful life of the apparatus.

According to the current invention, one or more pivot bars are rigidly mounted to the top faces of both lateral sidewalls of a container. One or more flanges extend outwardly from the roof of the container adjacent each pivot bar. The flanges terminate in ears that extend downwardly past each latch bar. The ears are disposed laterally outside of each latch bar, preferably touching the latch bar or as closely adjacent the latch bar as possible within manufacturing and operational tolerances. When the container is inverted, the ears and latch bars on the uppermost side form a pivot for the roof. Freely pivoting from each flange is a hook that falls by gravity and hooks under its latch bar when the container is upright. The hook serves the dual functions of securing the roof against vertical displacement during transit and of preventing the disengagement of the upper ears and latch bars during inversion of the container. During inversion of the container, the hooks associated with the lowermost side pivot away by gravity from engagement with the latch bars, thereby allowing the lower side of the roof to swing away from the container.

A lifting member operatively associated with each hook allows the roof to be moved while the container is upright, so that the container may be loaded by gravity.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
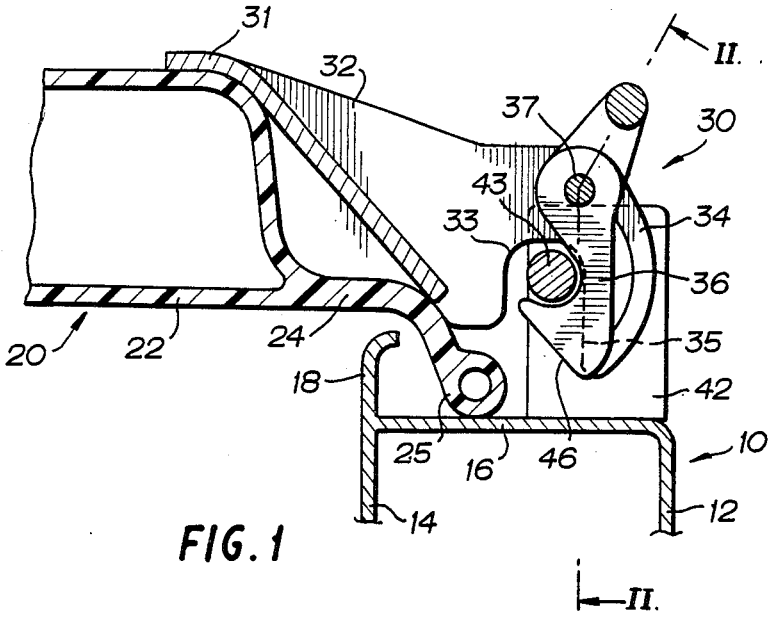
FIG. 1 is transverse sectional view of a latching hinge interconnecting a portion of a roof and the upper portion of a lateral sidewall of a container.

FIG. 1 shows the upper portion 10 of one of two lateral sidewalls of a container such as a railway car or the like. The sidewall comprises outer face 12, inner face 14 and upper face 16. Inner face 14 may advantageously terminate in a water barrier 18 which prevents the intrusion of rain water and the like into the container.

Covering the upper opening of the container is roof 20, which may advantageously be made of fiber reinforced plastic. An extreme lateral side portion of the roof is shown at 22 Supporting the roof is side flange 24 terminating in a rounded edge member 25 extending entirely around the perimeter of the roof. Flange 24 is shown in FIG. 1 resting on upper face 16 of the lateral sidewall.

Attachment member 31 secures the latching hinge of the current invention to the roof. Extending laterally outward from attachment member 31 are one or more laterally extending flanges 32.

It will be understood that the current invention resides in the hinge itself and in the overall operative relationship between the container and the roof. Therefore, flanges 32 may be attached to the roof using other means, and the roof and sidewall may differ from the designs shown. For example, it is not necessary that the upper face 16 of the sidewall be horizontal or that the roof be supported by a side flange such as shown at 24. Those skilled in the art will recognize that the roof and sidewall may take any of a variety of configurations. Likewise it will be realized that only a single flange 32 may be used. However, the preferred embodiment is illustrated.

The flanges 32 each terminate in a downwardly depending ear 34, each of which has a vertical inner face 35. The vertical inner face 35 is shown as a portion of a U-shaped opening 33 in flanges 32. However, it will be understood that the U-shaped opening is not necessary in all cases, and that the flange may extend rearwardly in a straight line to the roof or to an attachment member such as 31.

Figure 3:
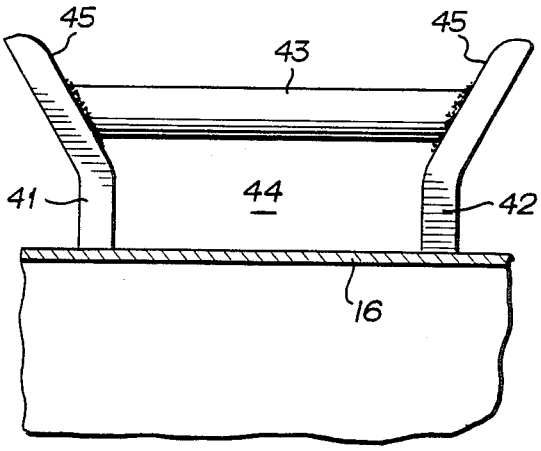
FIG. 3 is side view showing the installation of the latch bar on an upper sidewall of a container.
Figure 4:
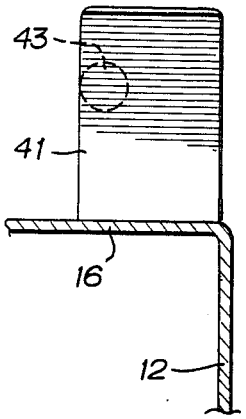
FIG. 4 is a side view of FIG. 3.

Ears 34 extend downwardly a distance sufficient for them to pass latch bar 43, which is secured to the upper face 16 of the lateral sidewall by latch bar supports 41, 42 (FIGS. 3 and 4). An upper portion of each latch bar support is angled longitudinally outward, as shown at 45. The latch bar is spaced from the upper sidewall a distance sufficient to form a clearance 44.

Figure 2:
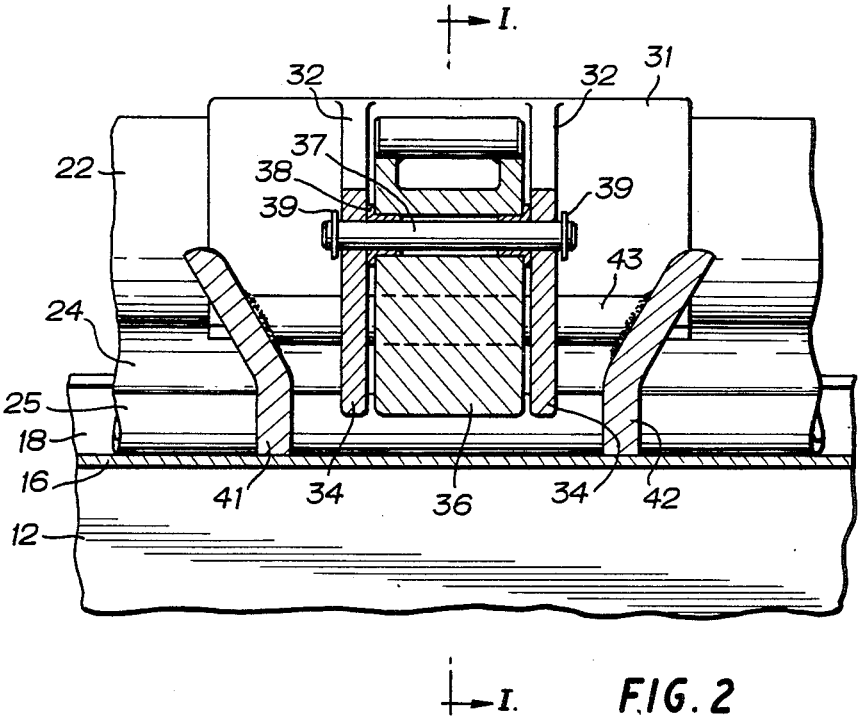
FIG. 2 is a side view, partly in section, taken on line II—II of FIG. 1.

As best seen in FIGS. 1 and 2, a hook 36 is pivotally mounted to the flanges 32 by pivot pin 37. Pivot pin 37 may be held in place by pins or clips 39 or the equivalent. It is preferable for hook 36 to be mounted for free pivotal motion with a minimum of friction. To achieve this result, flanged nylon bearings 38 or the equivalent may be used. When the container is upright as shown in FIG. 1, hook 36 hangs by gravity and enters the clearance 44, thereby securing the roof in place against vertical loading during transit.

The flanges 32 including their ears 34 and the hook 36 and its pivotal mounting together comprise a latch assembly. It will be understood that other configurations of latch assembly may be used. For example, pivot pin 37 may be extended and the hook mounted to the outside of the flanges 32. However, the preferred embodiment is illustrated.

It will be understood that any number of latch assemblies may be disposed along a lateral side of the roof. It is preferred that there be at least two latch assemblies on a side, but operation with one latch assembly on a side is possible. It will further be understood that the container will have another lateral sidewall 11 opposite the one 10 shown in FIG. 1, and that identical latch assemblies and latch bars will be provided at that other sidewall 11 (see FIG. 6).

Figure 5:
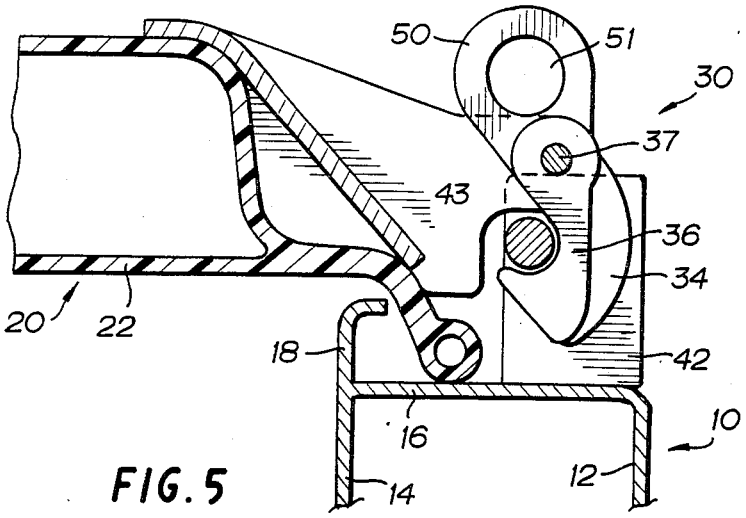
FIG. 5 is a view like FIG. 1, with the addition of a lifting member.

As shown in FIG. 5, one or more latch assemblies may be provided with lifting member 50, which includes attachment means such as a hole 51 or the equivalent. Lifting member 50 is used to engage a device such as a crane for lifting one or both sides of the roof. Lifting member 50 is operatively associated with the hooks 36, so that the upward force of the crane will cause hook 36 to move outwardly from clearance 44 and disengage from latch bar 43.

The operation of the reversible latching hinge will now be explained. In order to mate the roof with the container, as during initial assembly or after a top-loading operation, the roof will be lowered so that it may rest on the upper face 16. If during this operation the roof and container are slightly misaligned in the longitudinal direction, one of the ears 32 may contact the outward leaning portion 45 of a latch bar support. As the roof descends further, the face of the outward leaning portion will urge the roof into proper longitudinal alignment. At the same time, latch bar 43 will come into contact with lower tapered face 46 of hook 36, forcing it momentarily outward before it swings back by gravity into clearance 44 and hooks under latch bar 43. Simultaneously, vertical surfaces 35 of ears 34 move into position laterally outwardly of latch bar 43 and either contact the latch bar or rest adjacent the latch bar as close as is permitted by manufacturing and operational tolerances.

If it is desired to load the container by gravity, lifting member 50 may be engaged by a crane or the like and lifted, which will disengege hook 36 from latch bar 43 as explained above, and allow the roof to pivot about on the opposite sidewall at the point where it rests on the opposite sidewall. If desired, lifting members 50 associated with both lateral sides of the car may be engaged by the Crane, in which case the entire roof may be lifted from the container.

Figure 6:
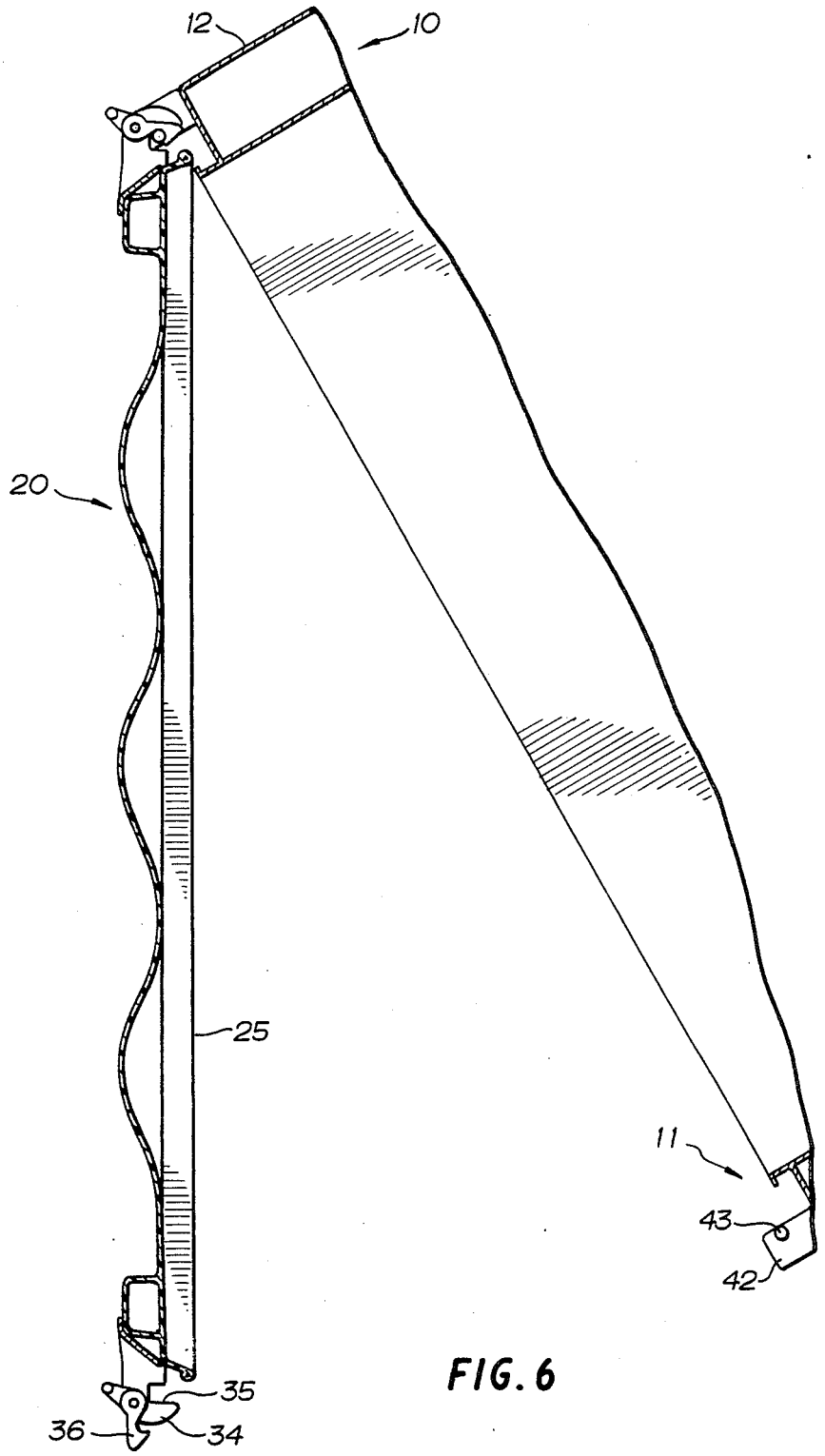
FIG. 6 is a transverse sectional view of the upper part of an inverted container and of the entire roof, including upper and lower latching hinges, as the roof is positioned during inversion.

As shown in FIG. 6, the container may be rotated about a longtidinal axis when it is desired to invert the container to dump its contents. In such an event, the latch assemblies associated with lateral sidewalls 10 will become upper latch assemblies, and those associated with the other lateral sidewall 11 will become lower latch assemblies. During such inversion, the hooks of the lower latch assemblies will swing laterally outward under the action of gravity and disengage from their respective latch bars 43, thereby permitting the lower edge of the roof to swing away from the opening of the container. In the meantime, the roof will be supported at the upper latches contact between upper latch bars 43 and upper ears 34. The point of contact between the upper latch bars and the upper ears will form a pivot point for allowing the roof to swing outwardly. Because of the proximity of the upper latch bars and the upper ears, no lateral displacement of the roof is needed to allow it to swing outwardly. Upper hooks 36 will remain engaged by gravity about the upper latch bars and will prevent the disengagement of the roof from the container which could result if the upper latch bars slipped off the inner faces 35 of the ears 36.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A container having an upper opening defined in part by lateral sidewalls of said container, each lateral sidewall terminating at its upper end in an upper face, a roof for said container comprising members for supporting said roof on said upper faces, and a first latch comprising a latch bar mounted on an upper face and elevated above said upper face to provide a clearance between said latch bar and said upper face, and a latch assembly fixed to said roof, said latch assembly comprising a flange fixed to said roof and projecting laterally therefrom over said latch bar, said flange terminating in an ear extending downwardly past said latch bar, closely adjacent thereto and disposed laterally outward thereof, said flange, ear and latch bar comprising pivot means about which said roof pivots when said container is inverted in a first direction for discharging its contents, said ear and said latch bar comprising means for preventing said roof from moving laterally with respect to said container during said inversion, said latch assembly further comprising a first hook attached to said flange for freely pivoting motion, said hook being disposed such that, when said roof rests on said upper faces, said first hook hangs by gravity and hooks under said latch bar in said clearance, said first hook comprising means for preventing said ear from disengaging from said latch bar during said inversion, further comprising a second latch of identical configuration to said first latch mounted on the upper face of the other lateral side of said container and on the opposite lateral side of said roof, said second latch comprising means for performing the recited functions of said first latch when said container is inverted in a second direction, said first hook and the hook of said second latch being weighted such that, during inversion in either said first or said second direction, the lower-most hook will pivot by gravity away from its associated latch bar, thereby freeing said roof to pivot.

2. The apparatus of claim 1, further including a lifting member having attachment means for connection with a lifting device for lifting said roof by an upward force at said lifting member, said lifting member comprising means for disengaging said first hook from said clearance in response to said upward force.

* * * * *